US007712149B2

(12) United States Patent
Baldwin

(10) Patent No.: US 7,712,149 B2
(45) Date of Patent: May 11, 2010

(54) PROTECTIVE ARTICLE OF OUTER CLOTHING

(75) Inventor: Roger Edwin Baldwin, Abingdon (GB)

(73) Assignee: High Voltage Pulse Technology Limited, Abingdon Oxfordshire (GB)

( * ) Notice: Subject to any disclaimer, the term of this patent is extended or adjusted under 35 U.S.C. 154(b) by 95 days.

(21) Appl. No.: 11/573,712

(22) PCT Filed: Aug. 16, 2005

(86) PCT No.: PCT/GB2005/003197

§ 371 (c)(1),
(2), (4) Date: Feb. 14, 2007

(87) PCT Pub. No.: WO2006/018623

PCT Pub. Date: Feb. 23, 2006

(65) Prior Publication Data

US 2007/0271689 A1 Nov. 29, 2007

(30) Foreign Application Priority Data

Aug. 17, 2004 (GB) ..... 0418288.7

(51) Int. Cl.
*F41H 1/02* (2006.01)

(52) U.S. Cl. ..... 2/2.5

(58) Field of Classification Search ..... 2/2.5, 2/455, 411, 412, 46, 81, 97, 102, 902, 905, 2/906; 428/902, 911; 442/117, 301, 377
See application file for complete search history.

(56) References Cited

U.S. PATENT DOCUMENTS

| | | | | |
|---|---|---|---|---|
| 5,906,004 | A * | 5/1999 | Lebby et al. | 2/1 |
| 6,272,781 | B1 * | 8/2001 | Resnick | 42/1.11 |
| 7,284,280 | B2 * | 10/2007 | Schultz | 2/2.5 |

FOREIGN PATENT DOCUMENTS

| | | | |
|---|---|---|---|
| DE | 39 17 631 | A1 | 12/1990 |
| DE | 40 18 356 | A1 | 12/1991 |
| DE | 197 43 389 | A1 | 4/1999 |
| DE | 101 17 006 | A1 | 10/2002 |
| DE | 103 53 582 | A1 | 6/2005 |
| FR | 2 779 669 | | 12/1999 |
| GB | 1 221 274 | | 2/1971 |
| WO | WO 95/30229 | | 11/1995 |
| WO | WO 96/20616 | | 7/1996 |
| WO | WO 96/37122 | | 11/1996 |
| WO | WO 03/094717 | A1 | 11/2003 |
| WO | WO 2004/006700 | A1 | 1/2004 |

* cited by examiner

*Primary Examiner*—Tejash Patel
(74) *Attorney, Agent, or Firm*—Workman Nydegger

(57) ABSTRACT

A protective article of outer-clothing (1,5) characterized in that the article: a) does not enshroud the head of the wearer; b} is not equipped with means for sensing and processing any electrical variations that the wearer's body produces; and c) incorporates an electricity conductive layer (12,14,16,17) which is selected to be of sufficiently low resistance that if, in use, prongs of a so-called stun gun are pressed against the article of clothing or located in proximity to the article and the gun is fired, the conductive layer (12,14,16,17) electrically interferes with the charge applied between the gun's prongs.

10 Claims, 3 Drawing Sheets

PROTECTIVE ARTICLE OF OUTER CLOTHING

FIELD OF THE INVENTION

The invention relates to protective articles of outer-clothing.

PRIOR ART KNOWN TO THE APPLICANT(S)

WO9637122 (Solera Rino) describes an under-garment comprising at least one portion made of fabric including a weave of non-conductive threads and conductive threads in which the conductive threads are interlaced so as to form a net with a pre-determined mesh.

GB1221274 (Central Electricity Generating Board) shows a screening suit including a hood of textile fabric with a mesh network of metal conductors woven into the fabric. The electric conducting strips of the suit are directly connected to a terminal connection for an external lead. The suit is a one piece garment with gloves and socks.

Another example of a full body suit is shown in DE4018356 (Weiss Dieter) which is made of anti-static fibre material. Further full body suits are presented in WO9620616 (Gorewl and Ass Gmbh), WO95/30229 (C.F. Ploucquet Gmbh and Co) and DE19743389 (University of Dresden).

More recent patent documents such as WO2004006700 (Rabinowicz), WO03094717 and FR2779669 (Angelidis Jean) all incorporate sensors some of which are in close contact with the wearer's body to sense electric signals generated by the body. Some of these prior published documents use sensors to determine electric fields, radio activity and heat flux.

None of these prior art articles of clothing would be suitable as a protective article of outer-clothing for every day use against potential attacks from stun guns which are increasingly occurring on exposed members of the public such as bus drivers or police officers.

SUMMARY OF THE INVENTION

In its broadest independent aspect, the invention provides a protective article of outer-clothing, characterised in that the article:

a) Does not enshroud the head of the wearer;

b) Is not equipped with means for sensing and processing any electrical variations that the wearer's body produces; and c) Incorporates an electricity conductive layer which is selected to be of sufficiently low resistance that if, in use, prongs of a so-called stun gun are pressed against the article of clothing or located in proximity to the article and the gun is fired, the conductive layer electrically interferes with the charge applied between the gun's prongs.

This configuration is particularly advantageous because it will allow users to wear protection without appearing to wear protection. This article of clothing will allow, for example, a bus driver to have the same level of comfort as he/she currently enjoys, it will not cause excessive levels of sweat or restrict the movements of the driver or even his sight. The interference with the charge applied between the gun's prongs will reduce the likelihood of any temporary disability of muscle control in order to prevent the usual 'stunning' effect which occurs with stun gun victims.

In a subsidiary aspect in accordance with the invention's broadest independent aspect, the electrical resistance between two points of impact separated by 50 mm is of less than 1 Ohm.

This is in sharp contrast with the prior art teaching for some electrical conductive suits used to prevent static electricity where a resistance over such a distance would be of the order of 1 Mega Ohm. Such levels of resistance will in effect cause the stun gun to be short circuited when fired onto a wearer.

In a further subsidiary aspect, the conductive layer is located underneath a conventional outer layer of everyday clothing. The term 'conventional clothing' may include uniforms such as those worn by the police and bus drivers. This marks a radical departure from the prior teaching of combining with an electrical conducting layer, an abrasion resistant outer layer of non-standard kind or a fire resistant layer of non-standard kind.

In a further subsidiary aspect, the conductive layers located between a conventional outer and a conventional inner layer of everyday clothing. This combination of features is also not envisaged in the prior art. The combination of features will allow the protective article to appear to the outside world as a conventional article of clothing but also be comfortable to the wearer himself/herself.

In a further subsidiary aspect, the conductive layer substantially covers a region located over the back of the wearer's body. This location is the statistically most probable location for stun gun attacks and therefore limiting the conductive layer to the back of the wearer's body will be beneficial in terms of cost and comfort.

In a further subsidiary aspect, the conductive layer substantially covers the front and back of the wearer's body without covering the wearer's hands and feet. This configuration also marks a radical departure from the prior art teaching that, all parts of the body ought to be protected. This is particularly true when referring to the Central Electricity Generating Board document of the prior art which necessarily protects the entire body.

In a further subsidiary aspect, the article of clothing comprises an anti-tear layer of a material such as that sold under the trade mark KEVLAR. The article of clothing of this kind will have a dual function of protecting, for example, a bus driver against both stun gun attacks and knife attacks.

In a further subsidiary aspect, the article further comprises impact absorbing means. These may assist in protecting, for example, a bus driver against grievous bodily harm caused by hitting coupled with the stun gun protection.

DETAILED DESCRIPTION OF THE FIGURES

Figure 1:
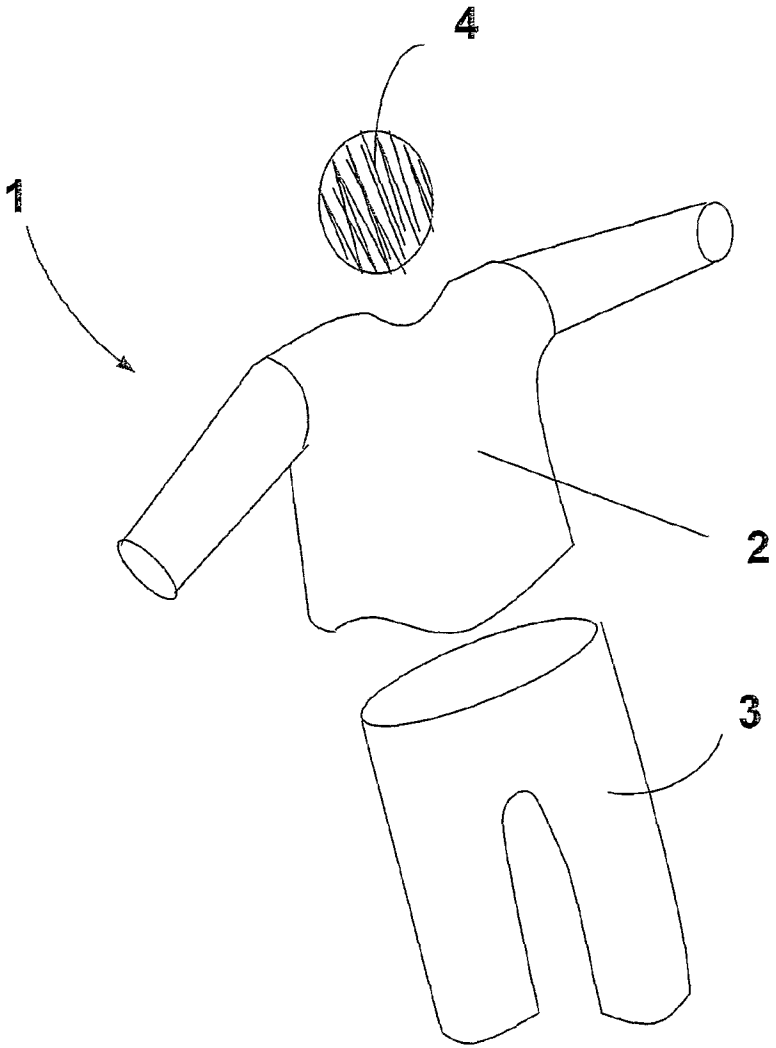
FIG. 1 shows, in schematic perspective view, a first embodiment of the invention's article of outer-clothing.

FIG. 1 shows a two-part article of protective clothing generally referenced 1 using a jacket 2 and trousers 3. The head 4 of a wearer is shown to give orientation to the figure, the perspective view shown in the figure being that of a wearer from his/her back. The article of outer-clothing will be selected to be of sufficient size to go over under garments or other clothing which would be in direct contact with the wearer's body. As the figure shows, the wearer's head is left exposed with the article of clothing covering only the arms but not the wearer's hands and the wearer's legs but not the wearer's feet.

Figure 3:
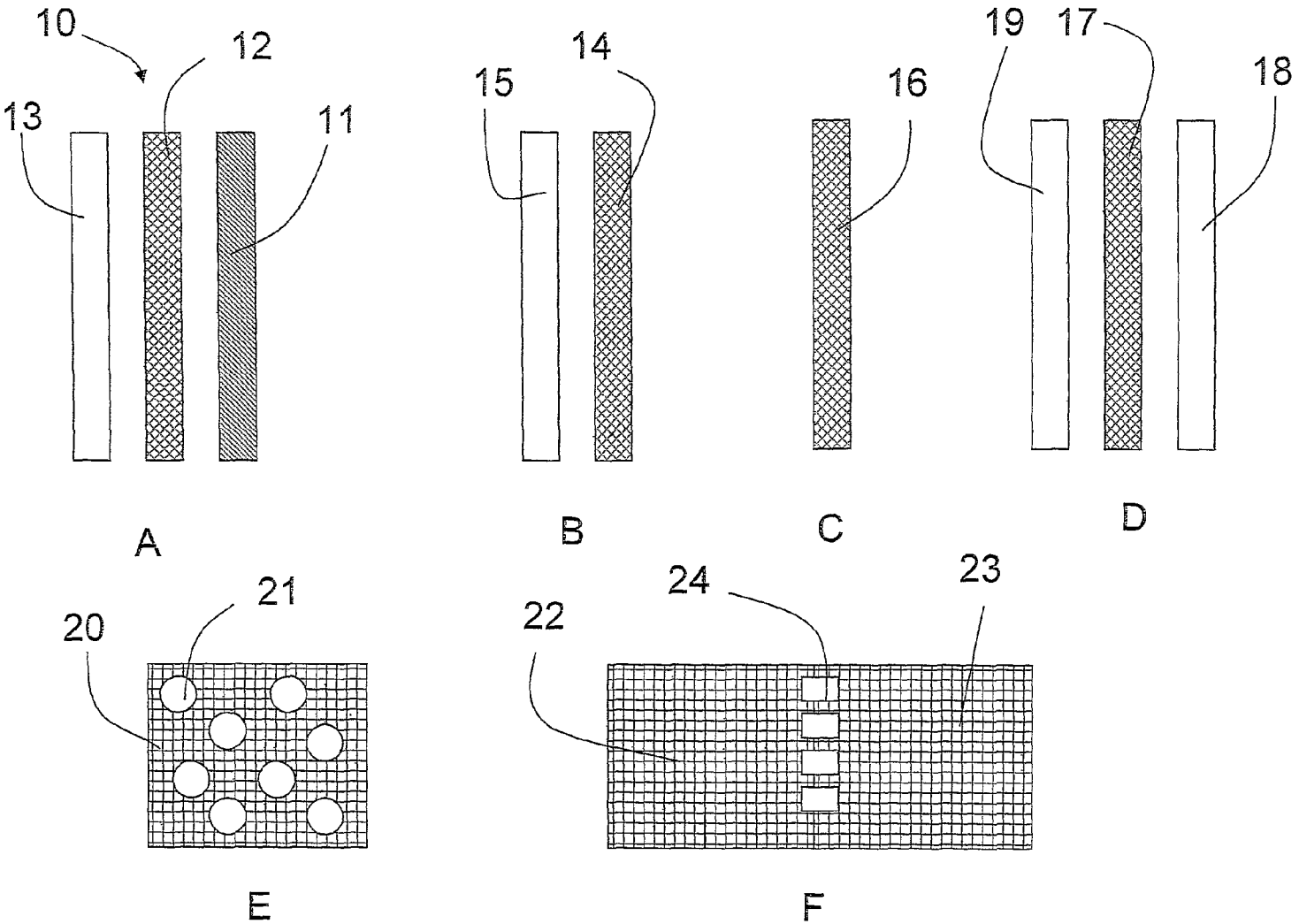
FIGS. 3*a, b, c* and *d* show schematic cross-sectional views of the layers of possible protective articles of outer-clothing according to the invention.
FIGS. 3*e* and *f* show schematic plan views of optional configurations of further embodiments of protective articles of outer-clothing in accordance with the invention.

The article of clothing may include several different layers as will be described in more detail with reference to FIG. 3. Both the jacket 2 and the trousers 3 will incorporate an electrically conductive layer with an electrical resistance between the two prong points of impact of a conventional stun gun separated by 50 mm would be of less than 1 Ohm. This may be, for example, a metal such as aluminium foil. This may also, for example, be copper based filaments.

With today's metal and textile manufacturing techniques, it is possible to manufacture metallic fibres of less than 1/10 of a millimeter so that the metallic conductive layer appears to the wearer to be like a silk, albeit with conductive properties. If the protective article of clothing is formed like a textile silk, it will appear light to the wearer and without any significant drawbacks in terms of retention of perspiration since the textile will have natural gaps or pores between the crossing fibres.

A material sold under the trademark FLECTRON used for electromagnetic field shielding in electromagnetic emitting field generating components could advantageously be used. This material takes the form of a Nickel/Copper Nylon material. The surface resistivity of this material is inferior to 0.07 ohms/square with far-field shielding effectiveness of 85 dB at 100 MHz and 75 dB at 1 GHz. Preferably, this material is also fire proof.

Figure 2:
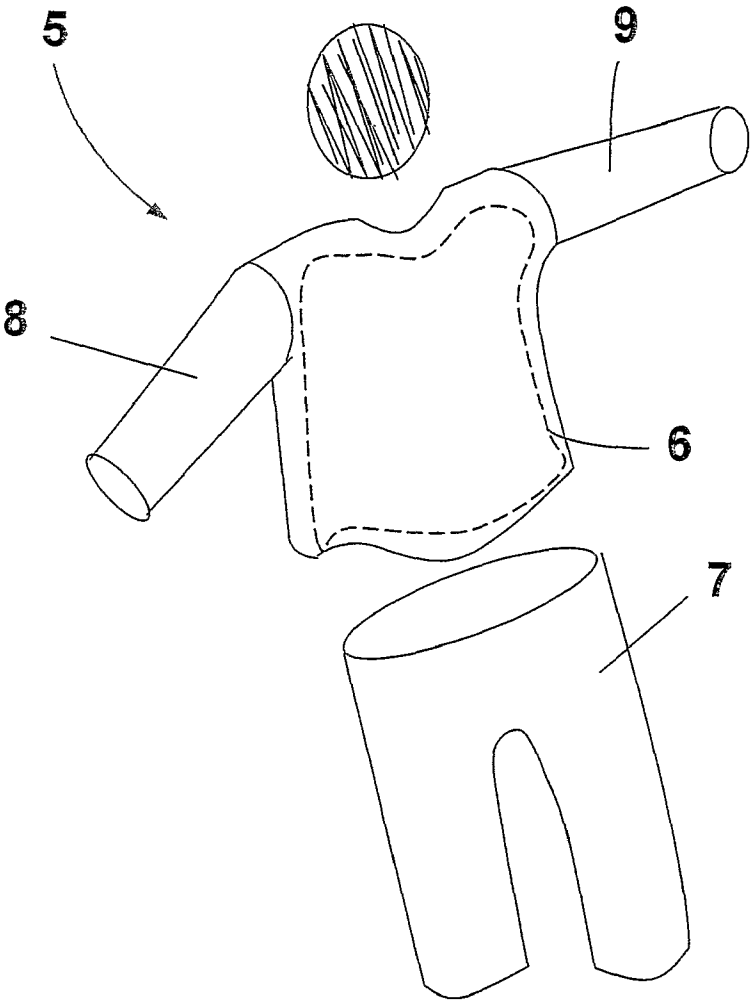
FIG. 2 shows, in schematic perspective view, a second embodiment of the invention's protective article of outer-clothing.

FIG. 2 shows a further protective article of clothing generally referenced 5. In this embodiment, the protective electrically conductive layer is shown in dashed lines 6 and thus covers the user's back only. The trousers 7 and the arms 8 and 9 of the clothing are in this embodiment conventional in their construction.

FIG. 3*a* shows a section generally referenced 10 through a protective article of clothing. The outer most layer 11 may be constructed of particularly tough material such as that currently sold under the trade mark KEVLAR which may assist against knife attacks. The first inner layer 12 located immediately beneath layer 11 is a conductive copper based textile material of sufficiently low resistance to short circuit a typical stun gun. For the purposes of this description, a typical stun gun voltage is 50,000 volts. An inner most layer 13 is presented immediately beneath layer 12 and may be, for example, of silk or other comfortable currently available lining fabric.

FIG. 3*b* shows a layer of protective conductive material 14 which would be located in the outer most position. This embodiment may also use a currently available comfortable inner lining layer 15. The gaps shown between 14 and 15 may be filled in with cushioning means such as those used in a motorcycle protective clothing technology in order to cushion any blow given by the impact of a stun gun.

FIG. 3*c* shows the use of a single layer of conductive material 16. In this embodiment, there are no inner or outer everyday wear layers.

FIG. 3*d* shows a conductive layer 17 sandwiched between a waterproof layer 18 and a thermally insulating layer 19.

FIG. 3*e* shows a conductive material mesh which may be used for conductive layers 12, 14, 16 and 17 described above. Conductive layer mesh 20 has a number of perforations 21 of larger diameter or general size than any gaps generated between the conductive textile. These perforations will have the advantage of giving the textile additional breathability whilst still adequately protecting against stun gun attacks.

FIG. 3*f* shows the junction of two conductive panels 22 and 23 such as those that would occur between a protective sleeve and a protective chest panel. In order to guarantee adequate conduction across the junction line, a number of bridges or weld points 24 may be used.

When the invention is embodied in a multi-part clothing arrangement such as a jacket and trousers, one or more copper wires or braids advantageously may be used to bridge gaps between parts.

Some of the preceding embodiments discuss the use of trousers. It is of course to be understood that the invention may be incorporated into a shirt.

A further advantage of the articles of clothing disclosed herein is that they may offer the wearer protection against electrocution from a direct lightning strike to the body. This could have particular benefits for example for a golfer caught in the open during a storm.

The scope of the invention is defined in the following claims.

The invention claimed is:

1. A protective article of outer-clothing configured to interfere with a charge applied by a stun gun, wherein the article:

a) does not enshroud the head of the wearer;

b) incorporates a plurality of panels forming said article; said panels having an electricity conductive textile layer formed of fibers with gaps between crossing fibers said layer being of sufficiently low resistance that in a first mode of use when prongs of a stun gun are pressed against the article of clothing; the conductive layer electrically interferes with the charge applied between the gun's prongs; and in a second mode of use when prongs of a stun gun are located in proximity to the article and the gun is fired, the conductive layer electrically interferes with the charge applied between the gun's prongs, wherein the electrical resistance between two prong points of impact separated by 50 millimeters is of less than 1 Ohm;

c) a junction line separating adjacent panels; and d) a bridge extending across said junction line: which establishes a conductive junction between a first and a second panel which is adequate to short circuit a stun gun.

2. An article according to claim 1, wherein the conductive layer is located underneath a conventional outer layer of everyday clothing.

3. An article according to claim 2, wherein the conductive layer is located between a conventional outer and a conventional inner layer of everyday clothing.

4. An article according to claim 1, wherein the conductive layer substantially covers a region located over the back of the wearer's body only.

5. An article according to claim 1, further comprising an anti-tear layer of a material such as that sold under the Trade Mark Kevlar.

6. An article according to claim 1, further comprising means for absorbing impact.

7. An article according to claim 1, further comprising a conductive textile layer, wherein said conductive textile layer is formed of nickel/copper nylon fibers.

8. An article according to claim 1, wherein said conductive textile layer is perforated in addition to the gaps between the fibers.

9. An article according to claim 1, wherein said textile fibers are of less than 1/10millimeters in diameter.

10. An article according to claim 1, wherein said bridge is in the form of a strip.

* * * * *